US012270408B2

(12) United States Patent
Huang et al.

(10) Patent No.: US 12,270,408 B2
(45) Date of Patent: Apr. 8, 2025

(54) CEILING FAN

(71) Applicant: DELTA ELECTRONICS, INC., Taoyuan (TW)

(72) Inventors: Sheng-Hsiang Huang, Taoyuan (TW); Chan-Yuan Tsao, Taoyuan (TW); Lung-Sheng Pan, Taoyuan (TW); Yen-Lin Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/372,082

(22) Filed: Sep. 23, 2023

(65) Prior Publication Data

US 2024/0426309 A1 Dec. 26, 2024

(30) Foreign Application Priority Data

Jun. 20, 2023 (CN) ..... 202310730377.1

(51) Int. Cl.
*F04D 25/08* (2006.01)
*F04D 29/34* (2006.01)

(52) U.S. Cl.
CPC ..... *F04D 25/088* (2013.01); *F04D 29/34* (2013.01)

(58) Field of Classification Search
None
See application file for complete search history.

(56) References Cited

U.S. PATENT DOCUMENTS

| | | | | |
|---|---|---|---|---|
| 2021/0040953 | A1 | 2/2021 | Kim et al. | |
| 2021/0199129 | A1* | 7/2021 | Xiao | F04D 29/34 |
| 2023/0235749 | A1* | 7/2023 | Yao | F04D 29/34 416/244 R |

FOREIGN PATENT DOCUMENTS

| | | | |
|---|---|---|---|
| CN | 204961350 | U | 1/2016 |
| CN | 212132205 | U | 12/2020 |
| CN | 215830766 | U | 2/2022 |
| CN | 216742166 | U | 6/2022 |
| CN | 217814041 | U | 11/2022 |
| TW | 202129158 | A | 8/2021 |

* cited by examiner

*Primary Examiner* — Juan G Flores
(74) *Attorney, Agent, or Firm* — CKC & Partners Co., LLC

(57) ABSTRACT

A ceiling fan includes an outer shield, a middle ring, a blade bracket, and a fan blade. The middle ring is pivotally connected to the outer shield and rotates relative to the outer shield. The blade bracket protrudes from the middle ring and has two guiding surfaces located on opposite sides of the blade bracket. The fan blade is combined with the middle ring by the blade bracket. The fan blade has an opening on an end close to the blade bracket. The fan blade further includes a housing, one or more supporting ribs, and two guiding limiting parts.

18 Claims, 12 Drawing Sheets

CEILING FAN

CROSS-REFERENCE TO RELATED APPLICATION

This application claims priority to China Application Serial Number 202310730377.1, filed Jun. 20, 2023, which is herein incorporated by reference in its entirety.

BACKGROUND

Field of Invention

The present disclosure relates to a ceiling fan.

Description of Related Art

In the process of assembling the known ceiling fan, most of the operators need to hold the fan blade by a single hand, while the other hand performs the operation of locking the screw. However, in the current practice, since the screws must be aligned with the holes, the operator then locks the screws from bottom to top to complete the assembly of the fan blade. This leads to the situation that the screws often fall to the ground during the assembly process, which is extremely inconvenient for the assembly process.

Therefore, how to propose a ceiling fan that can simplify the assembly steps and shorten the assembly time is one of the problems that the industry is eager to invest in research and development resources to solve.

SUMMARY

In view of this, one purpose of the present disclosure is to provide a ceiling fan that can solve the aforementioned problems.

In order to achieve the above objective, according to an embodiment of the present disclosure, a ceiling fan includes an outer shield, a middle ring, a blade bracket, and a fan blade. The middle ring is pivotally connected to the outer shield and rotates relative to the outer shield. The blade bracket is extended radially from the middle ring and has two guiding surfaces located on two opposite sides of the blade bracket, respectively. The fan blade is combined with the middle ring by the blade bracket. The fan blade has an opening at an end close to the blade bracket. The fan blade further includes a housing, one or more supporting ribs, and two guiding limiting parts. The housing includes a bottom plate and a top plate and has an accommodating space inside. The one or more supporting ribs protrude upward from the bottom plate of the housing in the accommodating space. The two guiding limiting parts are connected between the bottom plate and the top plate of the housing and disposed corresponding to the two guiding surfaces. The two guiding surfaces of the blade bracket are limited by the two guiding limiting parts, and the blade bracket is accommodated in the accommodating space and located between a top surface of the one or more supporting ribs and the top plate of the housing.

In one or more embodiments of the present disclosure, the one or more supporting ribs are elongated along a radial direction parallel to the fan blade.

In one or more embodiments of the present disclosure, at least one of the one or more supporting ribs is connected the top plate of the housing at an end thereof away from the middle ring.

In one or more embodiments of the present disclosure, the one or more supporting ribs are located between the two guiding limiting parts.

In one or more embodiments of the present disclosure, a distance is formed between the two guiding surfaces. The distance gradually shortens along a direction toward the fan blade.

In one or more embodiments of the present disclosure, the fan blade further includes a shielding plate. The shielding plate is located at an end of the fan blade close to the middle ring.

In one or more embodiments of the present disclosure, the ceiling fan includes a plurality of the fan blades, and a plurality of the shielding plates of the fan blades are spliced around a peripheral edge of the middle ring, respectively.

In one or more embodiments of the present disclosure, the blade bracket has a fixing hole, and the fan blade has a guiding hole disposed corresponding to the fixing hole.

In one or more embodiments of the present disclosure, the fan blade further includes a ring-shaped raised wall protruding outward from an outer surface of the top plate of the housing, and the guiding hole is located within a range of an inner edge of the ring-shaped raised wall.

In one or more embodiments of the present disclosure, the blade bracket further includes an elastic plate, and the fan blade has a positioning slot engaged with the elastic plate.

In one or more embodiments of the present disclosure, the blade bracket includes a positioning bump, and the fan blade has a notch engaged with the positioning bump.

In order to achieve the above objective, according to an embodiment of the present disclosure, a ceiling fan includes an outer shield, a middle ring, a blade bracket, and a fan blade. The middle ring is pivotally connected to the outer shield and rotates relative to the outer shield. The blade bracket is extended radially from the middle ring and has two guiding surfaces located on two opposite sides of the blade bracket respectively. The fan blade is combined with the middle ring by the blade bracket. The fan blade has an opening at an end close to the blade bracket. The fan blade further includes a housing, one or more supporting ribs, and two guiding limiting parts. The housing includes a bottom plate and a top plate and has an accommodating space inside. The one or more supporting ribs protrude upward from the bottom plate of the housing in the accommodating space. The two guiding limiting parts are connected between the bottom plate and the top plate of the housing and disposed corresponding to the two guiding surfaces. The one or more supporting ribs are elongated along a radial direction parallel to the fan blade.

In one or more embodiments of the present disclosure, the two guiding surfaces of the blade bracket are limited by the two guiding limiting parts. The blade bracket is accommodated in the accommodating space and located between a top surface of the one or more supporting ribs and the top plate of the housing.

In one or more embodiments of the present disclosure, at least one of the one or more supporting ribs is connected the top plate of the housing at an end thereof away from the middle ring.

In one or more embodiments of the present disclosure, the one or more supporting ribs are located between the two guiding limiting parts.

In one or more embodiments of the present disclosure, a distance is formed between the two guiding surfaces. The distance gradually shortens along a direction toward the fan blade.

In one or more embodiments of the present disclosure, the blade bracket has a fixing hole, and the fan blade has a guiding hole disposed corresponding to the fixing hole.

In one or more embodiments of the present disclosure, the fan blade further comprises a ring-shaped raised wall protruding outward from an outer surface of the top plate of the housing, and the guiding hole is located within a range of an inner edge of the ring-shaped raised wall.

In one or more embodiments of the present disclosure, the blade bracket further comprises an elastic plate, and the fan blade has a positioning slot engaged with the elastic plate.

In one or more embodiments of the present disclosure, the blade bracket comprises a positioning bump, and the fan blade has a notch engaged with the positioning bump.

In summary, in the ceiling fan of the present disclosure, since the blade bracket has the guiding surfaces and the fan blade includes the guiding limiting parts, the operator only needs to insert the locking member from top to bottom along the inner edge of the ring-shaped raised wall to the guiding holes to complete the accurate alignment for quick installation when installing the fan blade. In the ceiling fan of the present disclosure, since the fan blade includes the one or more supporting ribs, the supporting ribs and the top plate of the housing can clamp the blade bracket when the blade bracket is accommodated in the accommodating space of the blade. Therefore, the operator does not need to hold the fan blade by hand, and can achieve the effects of saving labor and time. In the ceiling fan of the present disclosure, since the elastic plate of the blade bracket is matched with the positioning slot of the fan blade, even if the screw is detached or loosened, the fan blade will not slip off and cause damage to people or objects, thereby further improving safety. In the ceiling fan of the present disclosure, since the fan blade has a guiding hole and a ring-shaped raised wall, even if the environment of installation prevents the operator from aligning the hole with naked eyes, the operator can achieve the blind-locking by hand.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
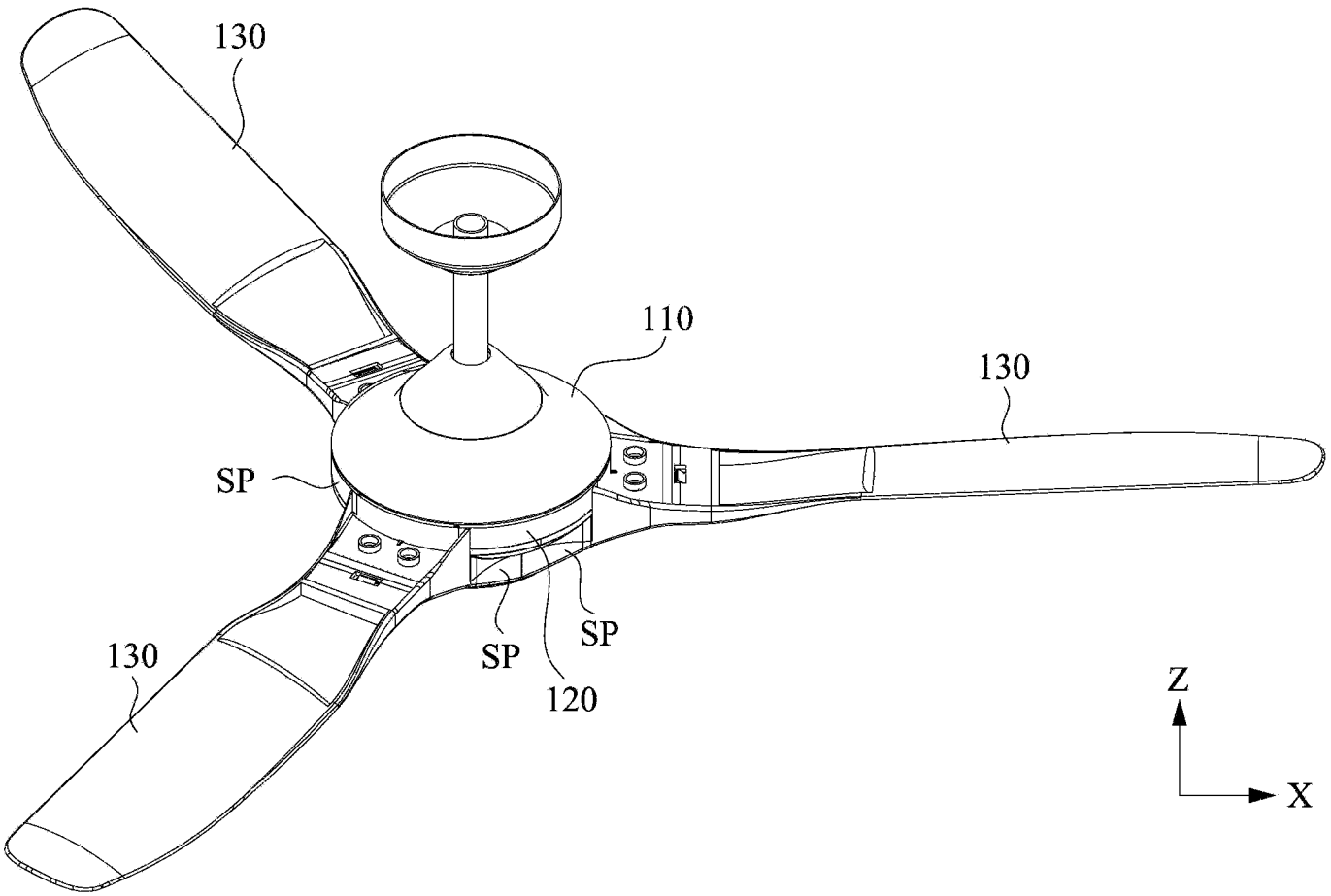
FIG. 1 is a perspective view of a ceiling fan in accordance with an embodiment of the present disclosure.

Hereinafter, a plurality of embodiments of the present disclosure will be disclosed in diagrams. For clarity of discussion, many details in practice will be described in the following description. However, it should be understood that these details in practice should not limit present disclosure. In other words, in some embodiments of present disclosure, these details in practice are unnecessary. In addition, for simplicity of the drawings, some conventionally used structures and elements will be shown in a simple schematic manner in the drawings. The same reference numbers are used in the drawings and the description to refer to the same or like parts.

Hereinafter, the structure and function of each component included in a ceiling fan 100 of this embodiment and the connection relationship between the components will be described in detail.

Reference is made to FIG. 1. FIG. 1 is a perspective view of a ceiling fan 100 according to an embodiment of the present disclosure. The ceiling fan 100 includes an outer shield 110, a middle ring 120, and a fan blade 130. The middle ring 120 is pivotally connected to the outer shield 110, and the middle ring 120 is configured to rotate relative to the outer shield 110. The fan blade 130 is combined with the middle ring 120 and configured to rotate with the middle ring 120 relative to the outer shield 110. The fan blade 130 includes a shielding plate SP. The shielding plate SP is located at an end of the fan blade 130 close to the middle ring 120.

In this embodiment, the ceiling fan 100 includes a plurality of fan blades 130. As shown in FIG. 1, the number of the fan blades 130 is three. However, the present disclosure does not intend to limit the number of fan blades 130. As shown in FIG. 1, the shielding plates SP of the fan blades 130 are spliced around a peripheral edge of the middle ring 120. The shielding plates SP can protect the components located in the middle ring 120 (such as a motor for driving the middle ring 120) from possible damage due to exposure.

Figure 2:
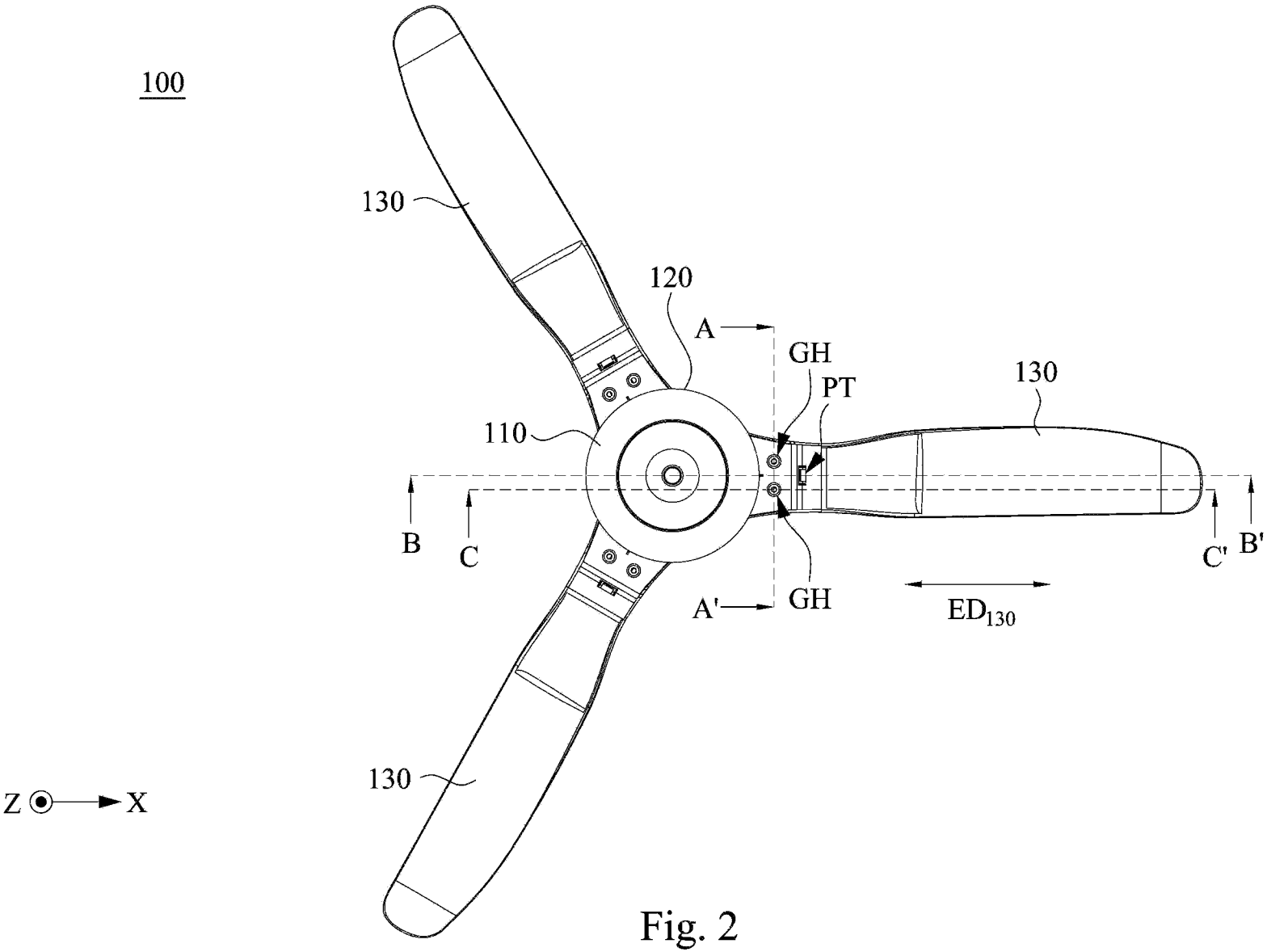
FIG. 2 is a top view of the ceiling fan in accordance with an embodiment of the present disclosure.

Reference is made to FIG. 2. FIG. 2 is a top view of the ceiling fan 100 shown in FIG. 1. The plurality of fan blades 130 are configured to rotate relative to the outer shield 110 along a rotation axis parallel to the z-direction. Each of the fan blades 130 has a guiding hole GH and a positioning slot PT. The guiding hole GH is configured to allow locking members to align (for example, locking screws), so as to facilitate the operators to install the fan blades 130. The positioning slot PT is configured to allow another protruding object to be combined therewith, so as to facilitate the auxiliary fixing between the fan blade 130 and the middle ring 120.

As shown in FIG. 2, the number of the guiding hole GH is two. However, the number of guiding hole GH is not limited thereto.

Figure 3:
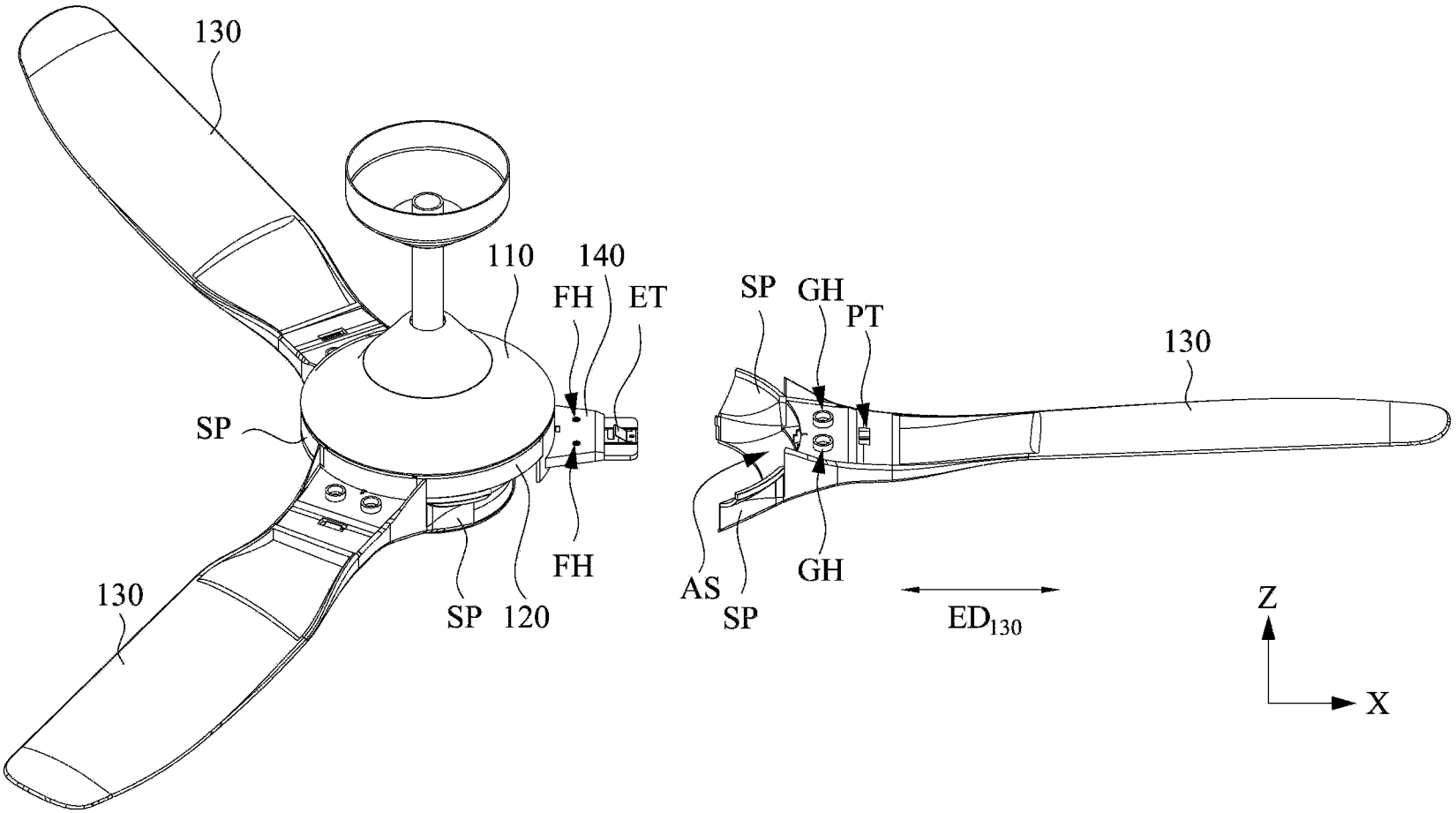
FIG. 3 is an exploded view of the ceiling fan in accordance with an embodiment of the present disclosure.

FIG. 3 is an exploded view of the ceiling fan 100 shown in FIG. 1. As shown in FIG. 3, the ceiling fan 100 further includes a blade bracket 140. The blade bracket 140 is extended radially (the x-direction) from the middle ring 120. The blade bracket 140 has a locking hole FH and includes an elastic plate ET. The guiding hole GH of the fan blade 130 is disposed corresponding to the locking hole FH of the blade bracket 140, and the positioning slot PT of the fan blade 130 is disposed corresponding to the elastic plate ET of the blade bracket 140. Furthermore, the fan blade 130 has an accommodating space AS. The fan blade 130 has an accommodating space AS configured to accommodate the blade bracket 140. In this figure, one of the fan blades 130 of the ceiling fan 100 is extended along a radial direction $ED_{130}$. When the blade bracket 140 is accommodated in the accommodating space AS of the fan blade 130, the fan blade 130 can be combined with the middle ring 120 along the radial direction $ED_{130}$ of the fan blade 130 through the blade bracket 140.

Figure 4:
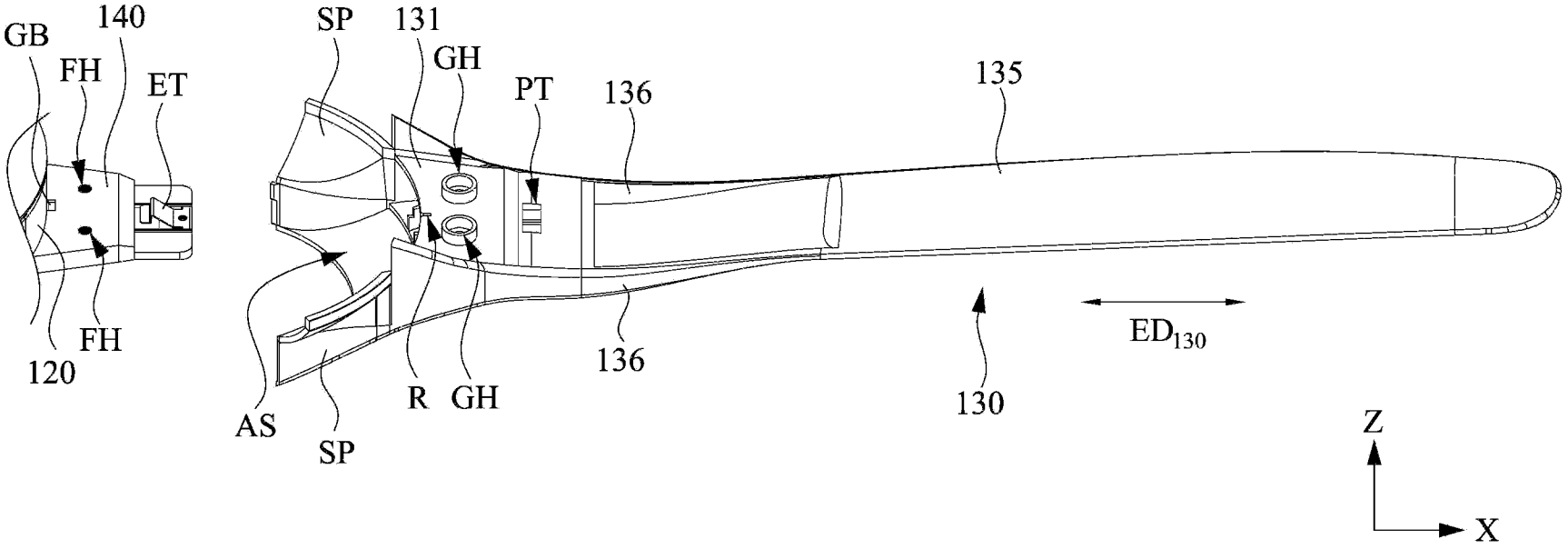
FIG. 4 is a perspective view of a fan blade and a blade bracket in accordance with an embodiment of the present disclosure.

Reference is made to FIG. 4. FIG. 4 is a perspective view of the fan blade 130 and the blade bracket 140 shown in FIG. 3, further illustrating the detailed structure of the fan blade 130 and the blade bracket 140. The fan blade 130 further includes a housing 131, a blade body 135, and supporting plates 136. The accommodating space AS is located inside the housing 131. In other words, the accommodating space AS is defined by the housing 131. The blade body 135 is extended toward a direction from the housing 131 and away from the middle ring 120. The supporting plates 136 are located on two sides of the blade body 135 and connect the blade body 135 and the housing 131. Since there is a level difference between the housing 131 and the blade body 135, the supporting plates 136 can eliminate the level difference and provide support on where the blade body 135 is connected to the housing 131. The fan blade 130 further has a notch R. The blade bracket 140 further includes positioning bumps GB. The notch R of the fan blade 130 is disposed corresponding to the positioning bumps GB of the blade bracket 140. The blade bracket 140 may also be provided with a notch R corresponding to the positioning bumps GB of the fan blade 130. This replacement of these elements is a variant that can be understood by people having ordinary skill.

Figure 5:
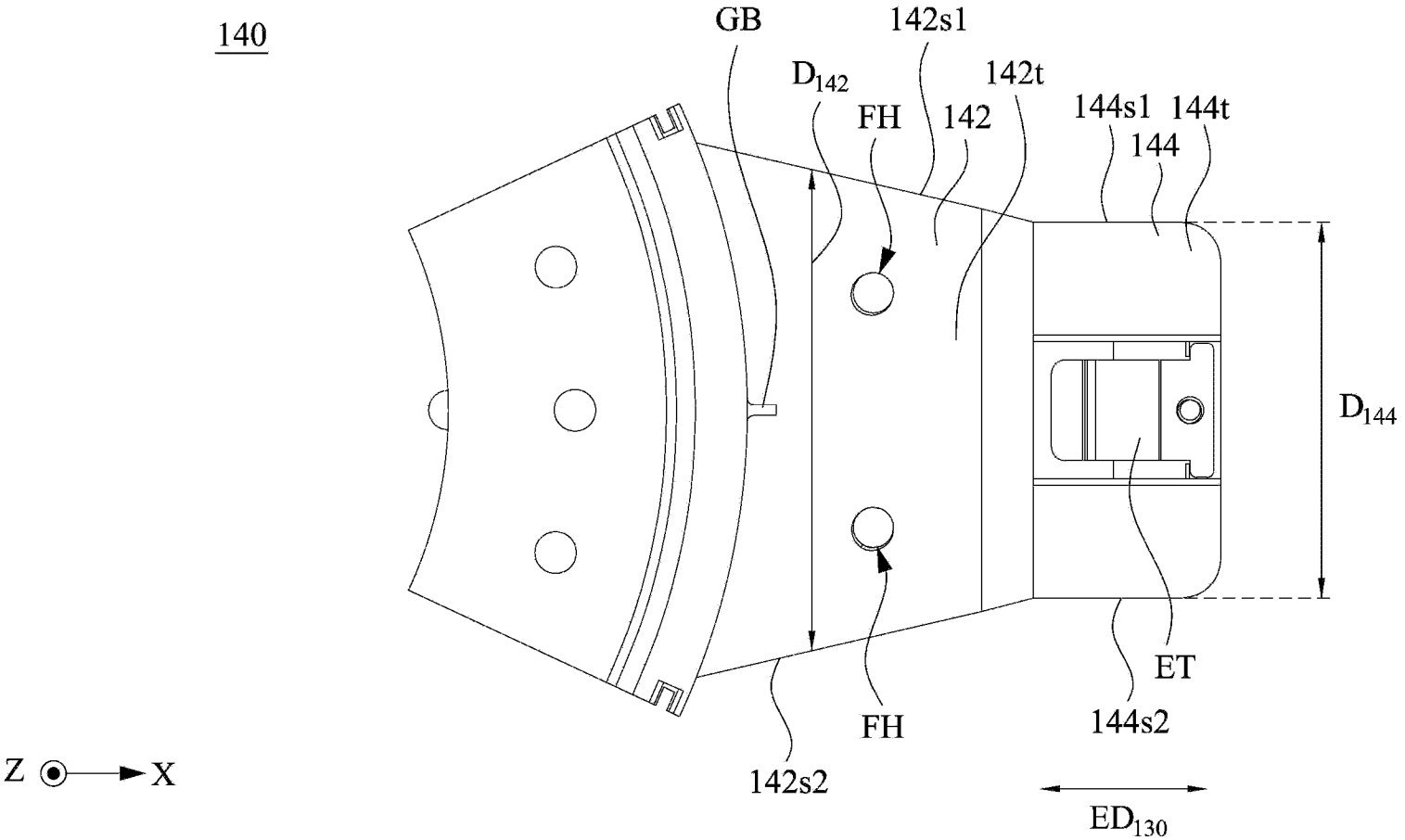
FIG. 5 is a top view of the blade bracket in accordance with an embodiment of the present disclosure.

Reference is made to FIG. 5. FIG. 5 is a top view of the blade bracket 140 shown in FIG. 4. The blade bracket 140 includes a first tongue portion 142 and a second tongue portion 144. The first tongue portion 142 is located on a side of the blade bracket 140 away from the fan blade 130, and the second tongue portion 144 is extended from the first tongue portion 142 and is located on a side close to the fan blade 130. The locking hole FH is located on a top surface 142*t* of the first tongue portion 142 and runs through the first tongue portion 142. The elastic plate ET is located on a top surface 144*t* of the second tongue portion 144. As shown in this figure, the first tongue portion 142 has a first guiding surface 142*s*1 and a second guiding surface 142*s*2 extending generally in the radial direction $ED_{130}$ of the fan blade 130 (x-direction). There is a distance $D_{142}$ formed between the first guiding surface 142*s*1 and the second guiding surface 142*s*2. The distance $D_{142}$ gradually shortens in a direction toward the fan blade 130. The second tongue portion 144 has a first guiding surface 144*s*1 and a second guiding surface 144*s*2 extending toward the radial direction $ED_{130}$ of the fan blade 130 (x-direction). There is a distance $D_{144}$ formed between the first guiding surface 144*s*1 and the second guiding surface 144*s*2. The distance $D_{144}$ remains constant along the radial direction $ED_{130}$ of the fan blade 130.

In this embodiment, the distance $D_{142}$ is greater than or equal to the distance $D_{144}$. The distance $D_{142}$ is equal to the distance $D_{144}$ at the junction of the first tongue portion 142 and the second tongue portion 144.

Figure 6:
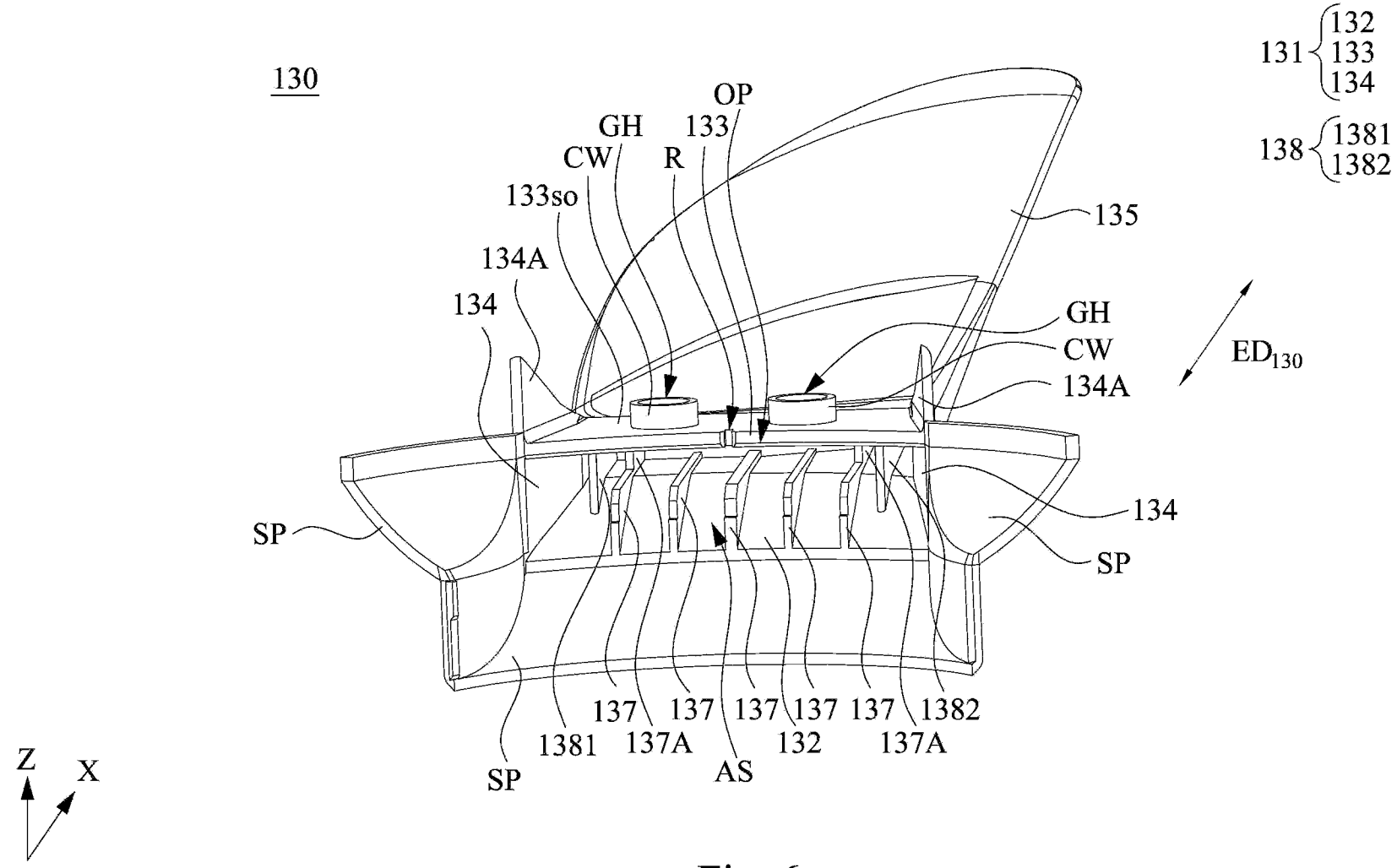
FIG. 6 is a perspective view of the ceiling fan in accordance with an embodiment of the present disclosure.

Reference is made to FIG. 6. FIG. 6 is a perspective view of the fan blade 130 of the present disclosure, which illustrates a more detailed structure of the fan blade 130. As shown in this figure, the housing 131 further includes a bottom plate 132, a top plate 133, and side plates 134. The bottom plate 132, the top plate 133, and the side plates 134 are spliced around to form the housing 131 and jointly define the accommodating space AS. The bottom plate 132 and the side plates 134 are connected to the shielding plate SP. The fan blade 130 has an opening OP at an end close to the blade bracket 140. Specifically, the bottom plate 132, the top plate 133, and the side plates 134 that are spliced around form the opening OP at an end away from the blade body 135. The top plate 133 of the housing 131 has an outer surface 133*so*, and the ring-shaped raised wall CW protrudes outward from the outer surface 133*so* of the top plate 133. In some embodiments, the guiding hole GH is located within a range of an inner edge of the ring-shaped raised wall CW. The fan blade 130 further includes fin portions 134A protruding outward from the outer surface 133*so* of the top plate 133. In this figure, the fin portions 134A may also be regarded as extended from the side plates 134. The notch R is located on the top plate 133. The notch R is located on the opening OP of the fan blade 130 and is recessed toward the blade body 135.

Reference is made again to FIG. 6. The fan blade 130 further includes one or more supporting ribs 137 and guiding limiting parts 138. The guiding limiting parts 138 include a first guiding limiting part 1381 and a second guiding limiting part 1382. The supporting ribs 137 are configured to provide support for the fan blade 130 and the blade bracket 140 when the blade bracket 140 is accommodated in the accommodating space AS of the fan blade 130. The supporting ribs 137 protrude upward from the bottom plate 132 of the housing 131 in the accommodating space AS. The first guiding limiting part 1381 and the second guiding limiting part 1382 are connected between the bottom plate 132 and the top plate 133 of the housing 131 and disposed corresponding to the first guiding surface 142*s*1 and the second guiding surface 142*s*2 of the blade bracket 140, such that the supporting ribs 137 is located between the first guiding limiting part 1381 and the second guiding limiting part 1382. The supporting ribs 137 are generally extended toward the radial direction $ED_{130}$ of the fan blade 130. The first guiding limiting part 1381 and the second guiding limiting part 1382 are also generally extended toward the radial direction $ED_{130}$ of the fan blade 130. At least one of the supporting ribs 137 is connected to the bottom plate 132 of the housing 131 at an end away from the middle ring 120. Specifically, at least one of the supporting ribs 137 includes a connecting portion 137A at an end away from the middle ring 120. Moreover, at least one of the supporting ribs 137 is connected to the bottom plate 132 and the top plate 133 through the connecting portion 137A.

Figure 7:
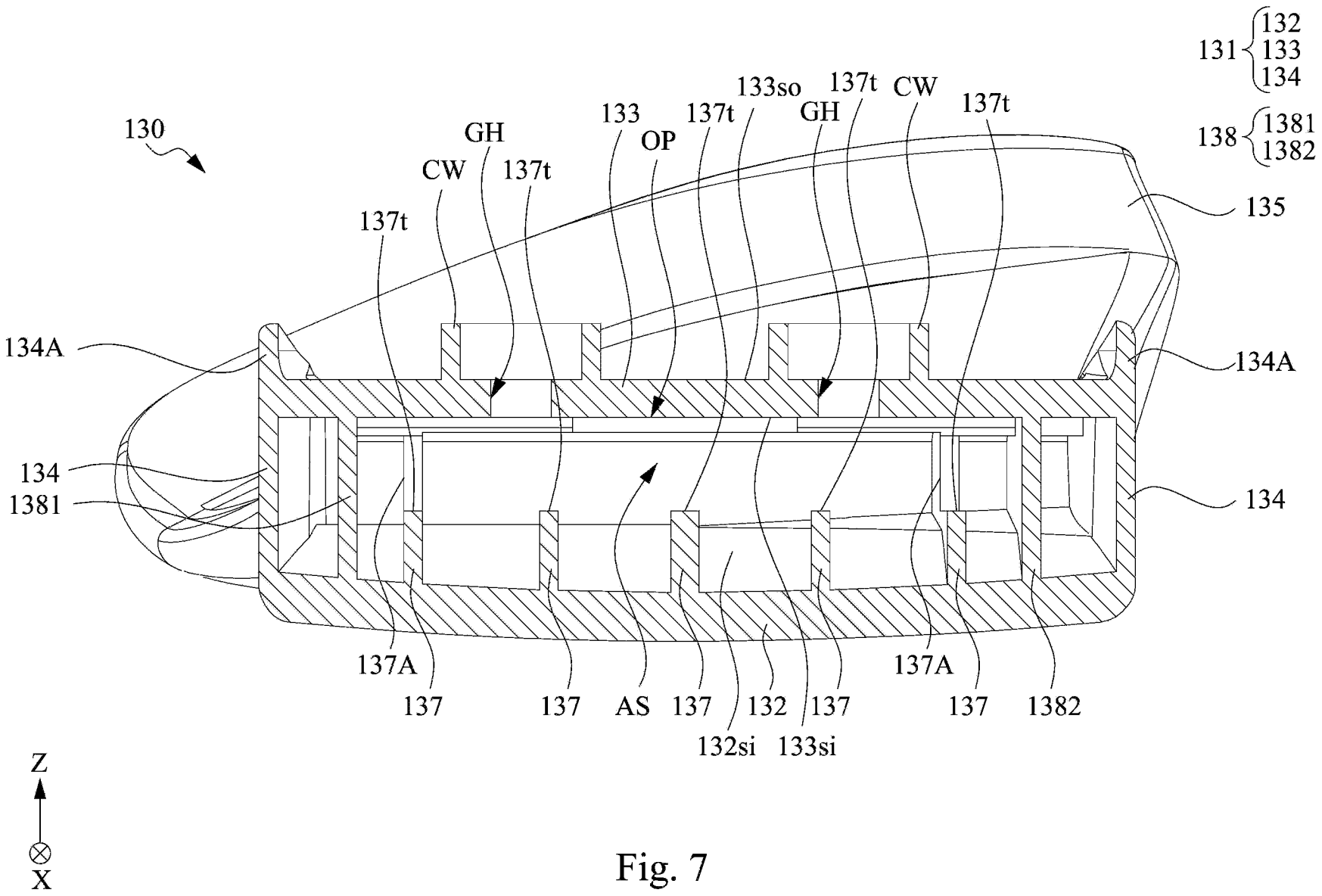
FIG. 7 is a cross-sectional view of the ceiling fan along a section A-A' of FIG. 2 in accordance with an embodiment of the present disclosure.

Reference is made to FIG. 7. FIG. 7 is a cross-sectional view of the fan blade 130 along a section A-A' in FIG. 2 of the present disclosure. The section A-A' shown in FIG. 2 is perpendicular to the radial direction $ED_{130}$ and passes through the guiding hole GH. As shown in FIG. 7, the first guiding limiting part 1381 and the second guiding limiting part 1382 are located between the two side plates 134, and the supporting ribs 137 are located between the first guiding limiting part 1381 and the second guiding limiting part 1382.

The supporting ribs 137 protrude from the bottom plate 132 of the housing 131 but not connected to the top plate 133. In some embodiments, each of the supporting ribs 137 protrudes from an inner surface 132*si* of the bottom plate 132 toward an inner surface 133*si* of the top plate 133 in the accommodating space AS. Each of the supporting ribs 137 has a top surface 137*t*, and each of the top surfaces 137*t* is separated from the inner surface 133*si* of the top plate 133, that is, the top surfaces 137*t* of the supporting ribs 137 are not connected to the inner surface 133*si* of the top plate 133.

In this embodiment, two of the supporting ribs 137 which are closest to the first guiding limiting part 1381 and the second guiding limiting part 1382 include the connecting portion 137A, but the present disclosure is not limited thereto.

In this embodiment, the fan blade 130 includes five supporting ribs 137, as shown in FIG. 7. However, the number of the supporting ribs 137 is not limited thereto.

Continued as shown in FIG. 7, the guiding hole GH runs through the top plate 133 of the housing 131. The space enclosed by the ring-shaped raised wall CW communicates with the guiding hole GH.

Figure 8:
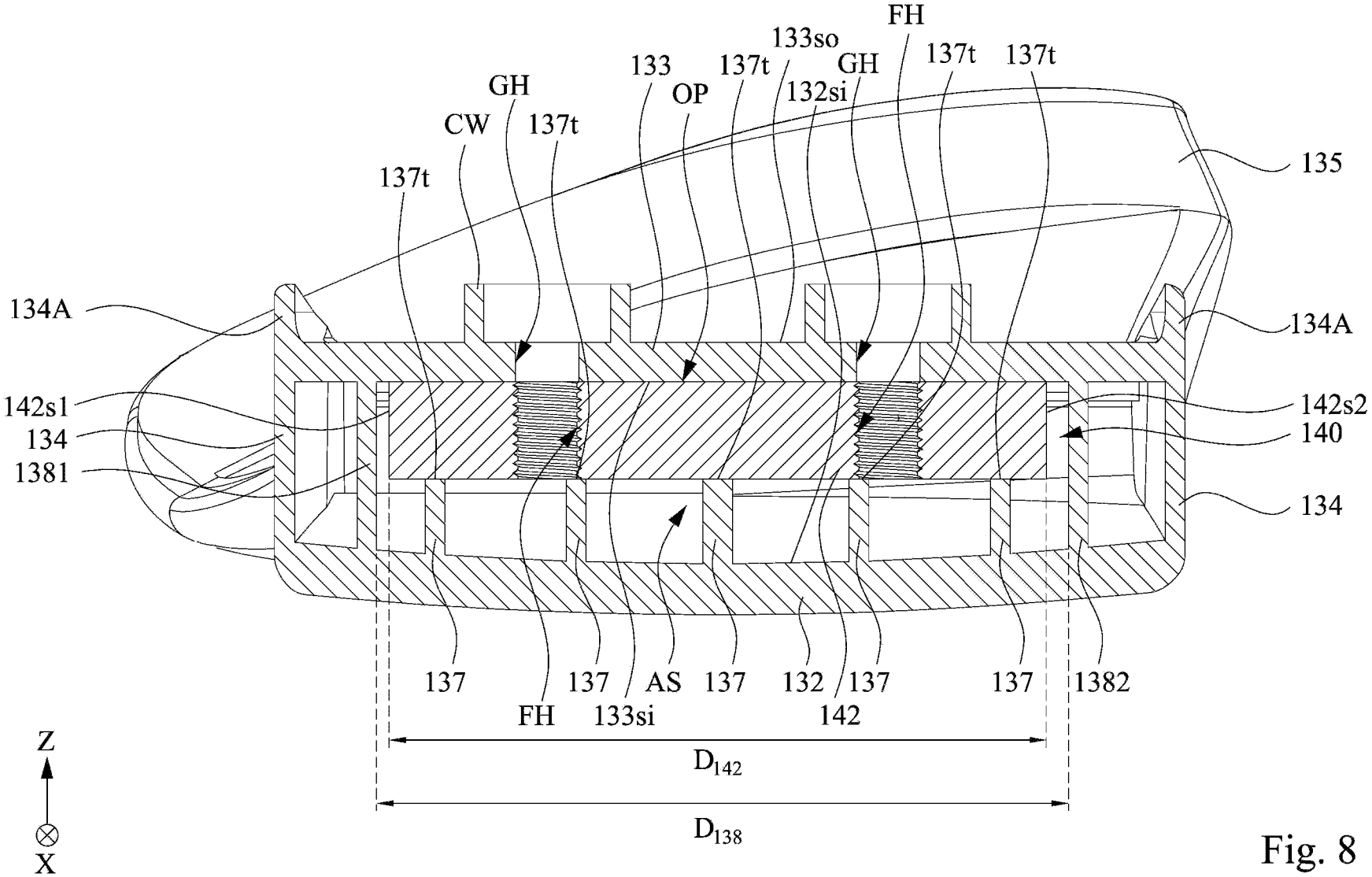
FIG. 8 is a cross-sectional view of the blade bracket coupled to the fan blade along the section A-A' of FIG. 2 in accordance with an embodiment of the present disclosure.

Reference is made to FIG. 8. FIG. 8 is a cross-sectional view of the blade bracket 140 coupled to the fan blade 130 along the section A-A' in FIG. 2 of the present disclosure. The blade bracket 140 shown in FIG. 8 is combined with the fan blade 130, that is, the blade bracket 140 is accommodated in the accommodating space AS of the fan blade 130. In detail, on the section A-A', the first tongue portion 142 of the blade bracket 140 is located in the accommodating space AS. When the blade bracket 140 is accommodated in the accommodating space AS, the first tongue portion 142 contacts the inner surface 133*si* of the top plate 133 and the top surface 137*t* of the supporting ribs 137 at the same time, and the locking holes FH running through the first tongue portion 142 and the guiding holes GH running through the top plate 133 are aligned in the direction (z-direction) from the bottom plate 132 toward the top plate 133. The locking holes FH may be, for example, a screw hole configured to be screwed with a locking member (for example, a locking screw), so that the locking member runs through the guiding hole GH and locks into the locking hole FH, and then reaches the purpose of the fan blade 130 coupled to the blade bracket 140.

Reference is made again to FIG. 8. When the blade bracket 140 is accommodated in the accommodating space AS, the first guiding surface 142*s*1 and the second guiding surface 142*s*2 of the first tongue portion 142 are respectively limited by the first guiding limiting part 1381 and the second guiding limiting part 1382, such that the blade bracket 140 is accommodated in the accommodating space AS and is located between the top surface 137*t* of the supporting ribs 137 and the top plate 133 of the housing 131, and such that the blade bracket 140 moves within the range between the first guiding limiting part 1381 and the second guiding limiting part 1382.

Continued as shown in FIG. 8, there is a distance $D_{138}$ formed between the first guiding limiting part 1381 and the second guiding limiting part 1382 along a direction perpendicular to the radial direction $ED_{130}$ of the fan blade 130. The distance $D_{138}$ between the first guiding limiting part 1381 and the second guiding limiting part 1382 is greater than or equal to the distance $D_{142}$ between the first guiding surface 142*s*1 and the second guiding surface 142*s*2.

Figure 9:
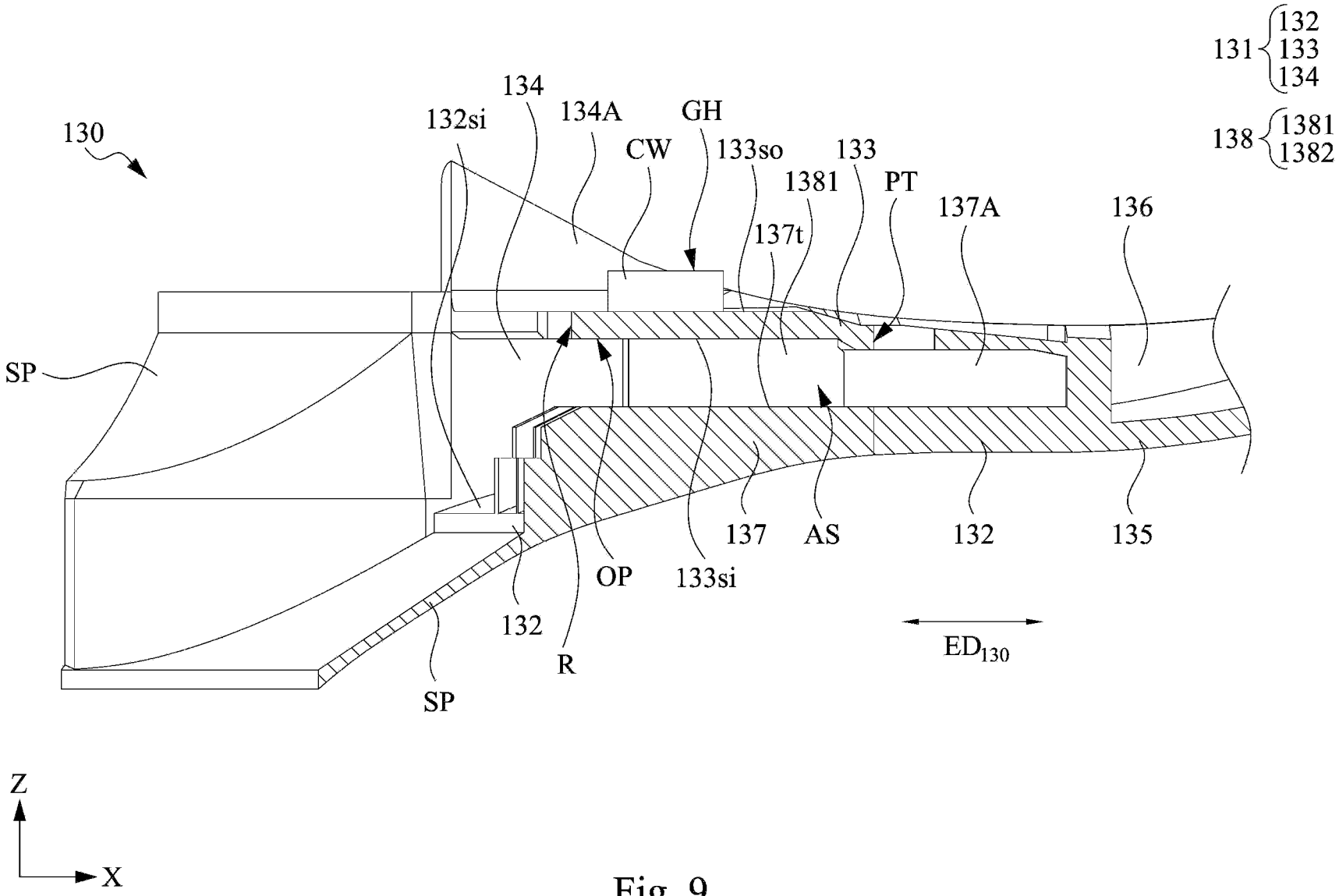
FIG. 9 is a cross-sectional view of the ceiling fan along a section B-B' of FIG. 2 in accordance with an embodiment of the present disclosure.

Reference is made to FIG. 9. FIG. 9 is a cross-sectional view of the fan blade 130 along a section B-B' in FIG. 2 of the present disclosure. The section B-B' in FIG. 2 is extended along the radial direction $ED_{130}$, and the section B-B' passes through the positioning slot PT but does not pass through the guiding holes GH. As shown in FIG. 9, the notch R is located at an end of the top plate 133 away from the blade body 135. The positioning slot PT is located at an end of the top plate 133 close to the blade body 135. The ring-shaped raised wall CW is disposed on the top plate 133 and located between the notch R and the positioning slot PT. As shown in FIG. 9, in some embodiments, the inner surface 132*si* of the bottom plate 132 is substantially a slant. Specifically, the inner surface 132*si* of the bottom plate 132 gradually approaches the inner surface 133*si* of the top plate 133 along the direction toward the blade body 135. In other words, the height of the supporting ribs 137 protruding from the inner surface 132*si* of the bottom plate 132 toward the inner surface 133*si* of the top plate 133 gradually decreases along the direction toward the blade body 135. As shown in FIG. 9, the blade body 135 is elongated along the radial direction $ED_{130}$. Alternatively, the blade body 135 may be generally regarded as an extending portion of the bottom plate 132.

Figure 10:
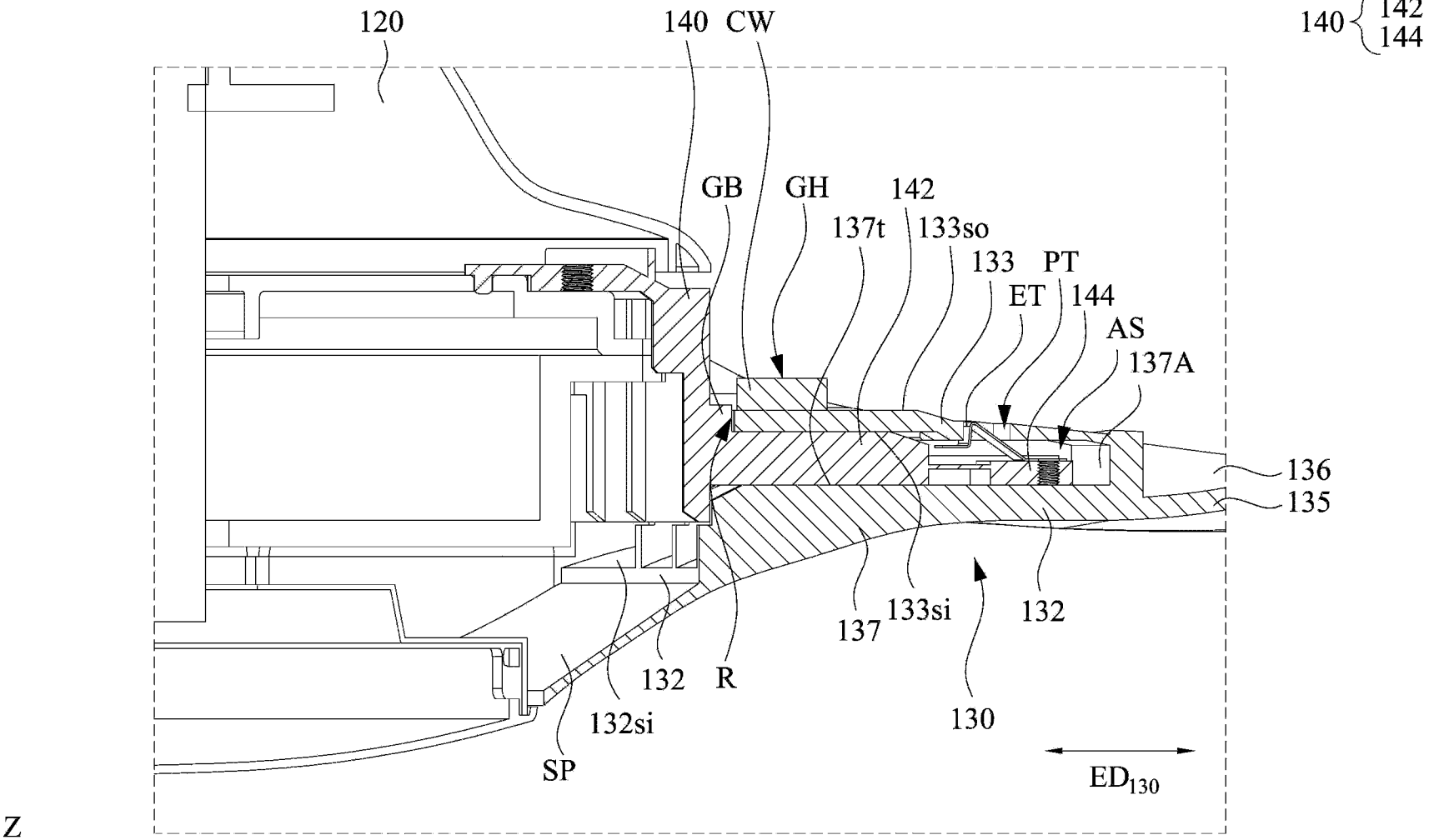
FIG. 10 is a cross-sectional view of the blade bracket coupled to the fan blade along the section B-B' of FIG. 2 in accordance with an embodiment of the present disclosure.

Reference is made to FIG. 10. FIG. 10 is a cross-sectional view of the blade bracket 140 coupled to the fan blade 130 along the section B-B' according to FIG. 2 of the present disclosure. As shown in FIG. 10, in this embodiment, the blade bracket 140 and the fan blade 130 are combined with each other along the radial direction $ED_{130}$. When the blade bracket 140 is combined with the fan blade 130, the notch R of the fan blade 130 engages with the positioning bumps GB of the blade bracket 140, and the positioning slot PT of the fan blade 130 is engaged with the elastic plate ET of the blade bracket 140. In some embodiments, the elastic plate ET is substantially bent, so that the bent portion of the elastic plate ET forms a protrusion, and then the bent portion of the elastic plate ET is engaged with the positioning slot PT. Simultaneously, the first tongue portion 142 of the blade bracket 140 is limited by the first guiding limiting part 1381 and the second guiding limiting part 1382, and the second tongue portion 144 of the blade bracket 140 is limited by the connecting portion 137A, as shown in FIG. 9 and FIG. 10.

Figure 11:
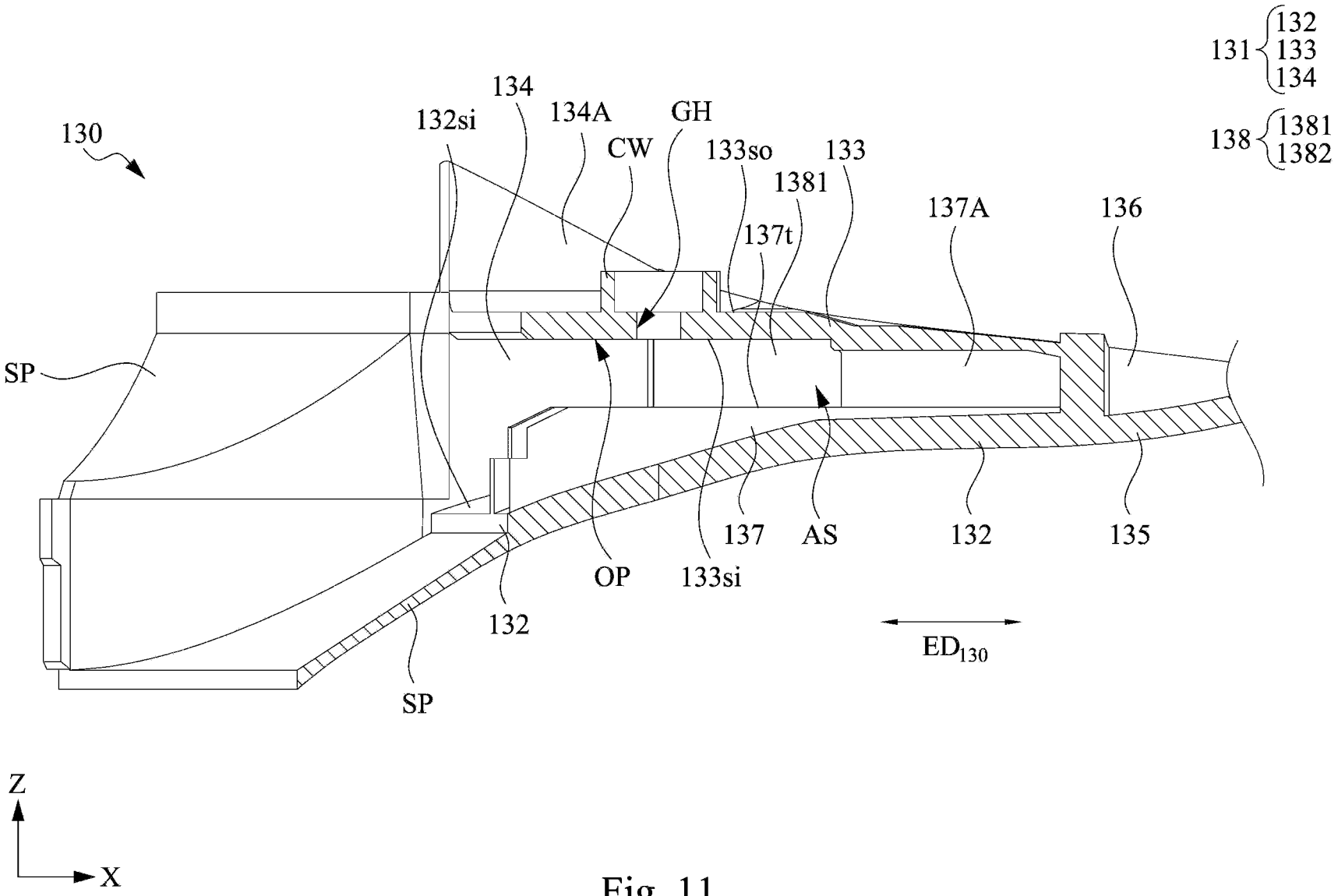
FIG. 11 is a cross-sectional view of the ceiling fan along a section C-C' of FIG. 2 in accordance with an embodiment of the present disclosure.

Reference is made to FIG. 11. FIG. 11 is a cross-sectional view of the fan blade 130 along a section C-C' according to FIG. 2 of the present disclosure. The section C-C' in FIG. 2 is extended along the radial direction $ED_{130}$ (x-direction), and the section C-C' passes through the guiding holes GH but does not pass through the positioning slot PT. As shown in FIG. 11, an inner diameter of the ring-shaped raised wall CW is greater than or equal to a diameter of the guiding hole GH, so as to match the shape of the head of the locking member (such as a locking screw). In some embodiments, the combination of the ring-shaped raised wall CW and the guiding hole GH may be, for example, a counterbore. Since the structural configuration in FIG. 11 is substantially similar to that in FIG. 9, repeated elements will not be described again.

Figure 12:
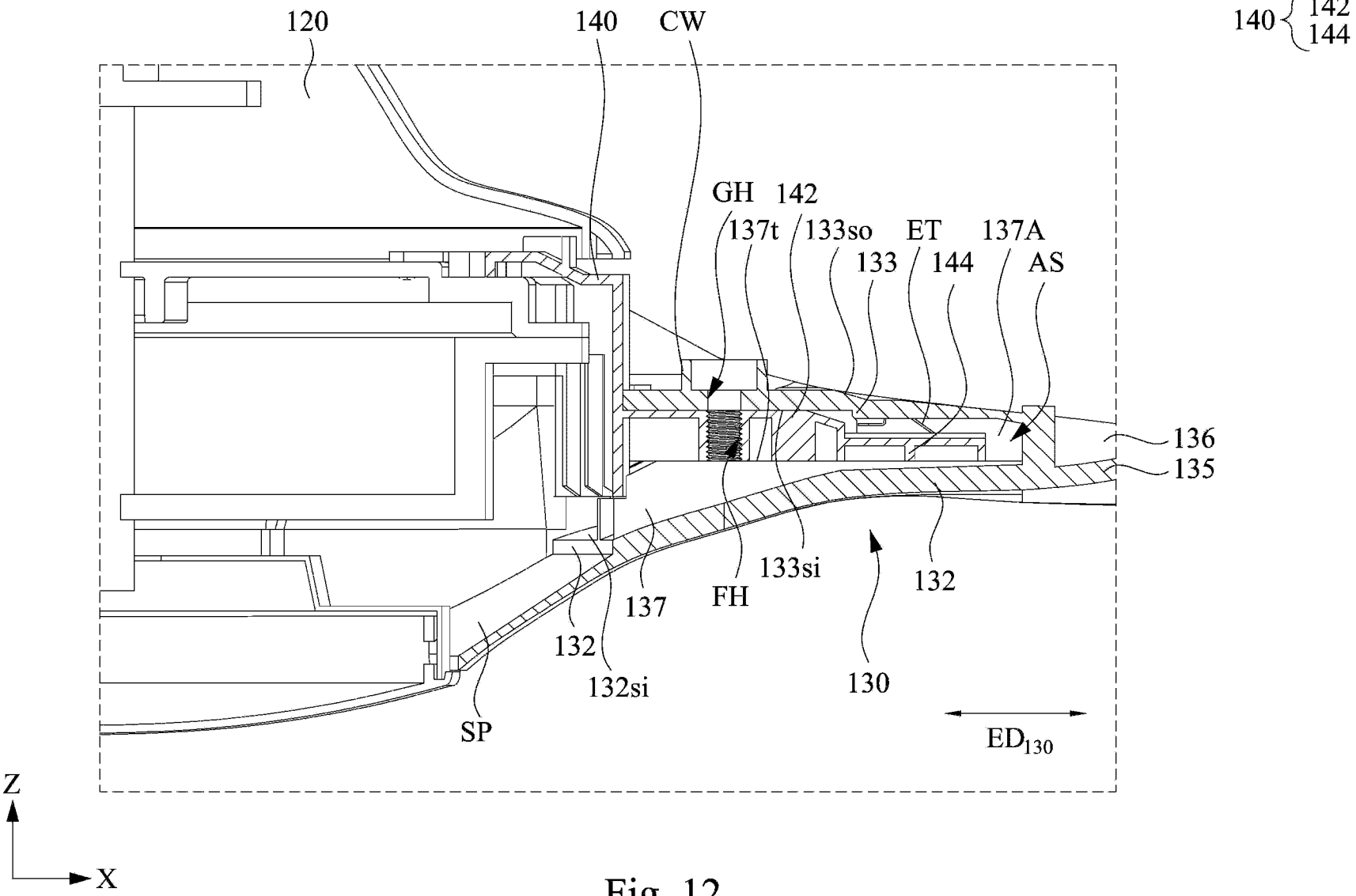
FIG. 12 is a cross-sectional view of the blade bracket coupled to the fan blade along the section C-C' of FIG. 2 in accordance with an embodiment of the present disclosure.

Reference is made to FIG. 12. FIG. 12 is a cross-sectional view of the blade bracket 140 coupled to the fan blade 130 along the section C-C' in FIG. 2 of the present disclosure. When the blade bracket 140 is combined with the fan blade 130, except for the combination between the notch R and the positioning bumps GB and the engagement between the positioning slot PT and the elastic plate ET, the guiding holes GH of the fan blade 130 and the locking holes FH of the blade bracket 140 are aligned and communicate with each other, so that additional locking members (for example, locking screws) can be screwed into the locking holes FH, and the fan blade 130 and the blade bracket 140 are fastened to each other. Since the structural configuration in FIG. 12 is substantially similar to that in FIG. 10, repeated elements will not be described again.

With the aforementioned structural configuration, in a usage scenario, when an operator on the ground intends to install the fan blade 130 on, for example, the middle ring 120 fixed on the ceiling, the operator holds the fan blade 130 and put one end of the opening OP of the fan blade 130 facing the blade bracket 140. Next, the operator abuts the fan blade 130 against the middle ring 120 along the radial direction $ED_{130}$. Next, the blade bracket 140 is accommodated in the accommodating space AS located in the housing 131 of the fan blade 130, so that the notch R engages with the positioning protrusion GB and the positioning slot PT engages with the elastic plate ET, so as to achieve the preliminary positioning and the limiting functions between the blade bracket 140 and the fan blade 130. Since the operator is located below the ceiling fan 100, the operator cannot observe the outer surface 133*so* of the top plate 133 of the fan blade 130. Therefore, the operator determines the position of the ring-shaped raised wall CW by touching the outer surface 133*so* of the top plate 133 with tactile feedback. Then, the operator installs the locking member (such as a locking screw) from the ring-shaped raised wall CW into the guiding hole GH under the situation that the vision cannot reach the ring-shaped raised wall CW. Finally, the operator uses additional tools to lock the above-mentioned locking members into the guiding hole GH and the locking hole FH communicating with the guiding hole GH, and completes the installation operation of the fan blade 130 by means of blind locking by hand.

In a usage scenario, when an operator on the ground intends to unload the fan blade 130 from (for example, the middle ring 120 fixed on the ceiling), the operator touches the outer surface 133*so* of the top plate 133 to determine the location of the ring-shaped raised wall CW by tactile feedback. Next, the operator uses an additional tool to loosen the above-mentioned locking member from the guiding hole GH and the locking hole FH. Next, the operator holds the fan blade 130 and applies force along the radial direction $ED_{130}$ in a direction away from the middle ring 120. At the moment, since the positioning slot PT is engaged with the elastic plate ET to provide positioning and limiting functions, the fan blade 130 will not fall to the ground because of the above-mentioned loosened locking member. Next, the operator continues to apply force on the fan blade 130, so that the positioning slot PT and the elastic plate ET are separated from each other. Finally, the operator holds the fan blade 130 moving away from the middle ring 120, so that the blade bracket 140 is separated from the accommodating space AS of the fan blade 130, so as to complete the unloading operation of the fan blade 130.

Based on the above discussions, it can be seen that in the ceiling fan of the present disclosure, since the blade bracket has the guiding surfaces and the fan blade includes the guiding limiting parts, the operator only needs to insert the locking member from top to bottom along the inner edge of the ring-shaped raised wall to the guiding holes to complete the accurate alignment for quick installation when installing the fan blade. In the ceiling fan of the present disclosure, since the fan blade includes the one or more supporting ribs, the supporting ribs and the top plate of the housing can clamp the blade bracket when the blade bracket is accommodated in the accommodating space of the blade. Therefore, the operator does not need to hold the fan blade by hand, and can achieve the effects of saving labor and time. In the ceiling fan of the present disclosure, since the elastic plate of the blade bracket is matched with the positioning slot of the fan blade, even if the screw is detached or loosened, the fan blade will not slip off and cause damage to people or objects, thereby further improving safety. In the ceiling fan of the present disclosure, since the fan blade has a guiding hole and a ring-shaped raised wall, even if the environment of installation prevents the operator from aligning the hole with naked eyes, the operator can achieve the blind-locking by hand.

Although the present disclosure has been disclosed as above in the manner of embodiment, it is not intended to limit the present disclosure. Those skilled in the art can make various changes and modifications without departing from the spirit and scope of the present disclosure. Therefore, the scope of the present disclosure shall be subject to the scope of the attached claims.

What is claimed is:

1. A ceiling fan, comprising:

an outer shield;

a middle ring pivotally connected to the outer shield and rotating relative to the outer shield;

a blade bracket is extended radially from the middle ring and having two guiding surfaces located on two opposite sides of the blade bracket; and a fan blade combined with the middle ring by the blade bracket, and the fan blade has an opening at an end facing the blade bracket, wherein the fan blade further comprising:

a housing comprising a bottom plate and a top plate and having an accommodating space inside;

one or more supporting ribs protruding upward from the bottom plate of the housing in the accommodating space; and two guiding limiting parts connected between the bottom plate and the top plate of the housing and disposed corresponding to the two guiding surfaces, wherein the two guiding surfaces of the blade bracket are limited by the two guiding limiting parts, and the blade bracket is accommodated in the accommodating space and located between a top surface of the one or more supporting ribs and the top plate of the housing, wherein at least one of the one or more supporting ribs is connected to the top plate of the housing at an end thereof away from the middle ring.

2. The ceiling fan of claim 1, wherein the one or more supporting ribs are elongated along a radial direction parallel to the fan blade.

3. The ceiling fan of claim 1, wherein the one or more supporting ribs are located between the two guiding limiting parts.

4. The ceiling fan of claim 1, wherein a distance formed between the two guiding surfaces gradually shortens along a direction toward the fan blade.

5. The ceiling fan of claim 1, wherein the fan blade further comprises a shielding plate, and the shielding plate is located at an end of the fan blade facing the middle ring.

6. The ceiling fan of claim 5, wherein the ceiling fan comprises a plurality of the fan blades, and a plurality of the shielding plates of the fan blades are spliced around a peripheral edge of the middle ring, respectively.

7. The ceiling fan of claim 1, wherein the blade bracket has a fixing hole, and the fan blade has a guiding hole disposed corresponding to the fixing hole.

8. The ceiling fan of claim 7, wherein the fan blade further comprises a ring-shaped raised wall protruding outward from an outer surface of the top plate of the housing, and the guiding hole is located within a range of an inner edge of the ring-shaped raised wall.

9. The ceiling fan of claim 1, wherein the blade bracket further comprises an elastic plate, and the fan blade has a positioning slot engaged with the elastic plate.

10. The ceiling fan of claim 1, wherein the blade bracket comprises a positioning bump, and the fan blade has a notch engaged with the positioning bump.

11. A ceiling fan, comprising:

an outer shield;

a middle ring pivotally connected to the outer shield and rotating relative to the outer shield;

a blade bracket extended radially from the middle ring and having two guiding surfaces located on two opposite sides of the blade bracket respectively; and a fan blade combined with the middle ring by the blade bracket, the fan blade having an opening at an end facing the blade bracket, wherein the fan blade further comprises:

a housing comprising a bottom plate and a top plate and having an accommodating space inside;

one or more supporting ribs protruding upward from the bottom plate of the housing in the accommodating space; and two guiding limiting parts connected between the bottom plate and the top plate of the housing and disposed corresponding to the two guiding surfaces, wherein the one or more supporting ribs are elongated along a radial direction parallel to the fan blade, wherein at least one of the one or more supporting ribs is connected to the top plate of the housing at an end thereof away from the middle ring.

12. The ceiling fan of claim 11, wherein the fan blade further comprises a shielding plate, and the shielding plate is located at an end of the fan blade facing the middle ring.

13. The ceiling fan of claim 11, wherein the one or more supporting ribs are located between the two guiding limiting parts.

14. The ceiling fan of claim 11, wherein a distance formed between the two guiding surfaces gradually shortens along a direction toward the fan blade.

15. The ceiling fan of claim 11, wherein the blade bracket has a fixing hole, and the fan blade has a guiding hole disposed corresponding to the fixing hole.

16. The ceiling fan of claim 15, wherein the fan blade further comprises a ring-shaped raised wall protruding outward from an outer surface of the top plate of the housing, and the guiding hole is located within a range of an inner edge of the ring-shaped raised wall.

17. The ceiling fan of claim 11, wherein the blade bracket further comprises an elastic plate, and the fan blade has a positioning slot engaged with the elastic plate.

18. The ceiling fan of claim 17, wherein the blade bracket comprises a positioning bump, and the fan blade has a notch engaged with the positioning bump.

* * * * *